US007014399B1

(12) United States Patent
Hsieh

(10) Patent No.: US 7,014,399 B1
(45) Date of Patent: Mar. 21, 2006

(54) FASTENER FOR SECURING CARGO CONTAINERS HAVING A RESTRAINING MECHANISM

(76) Inventor: David Hsieh, 3F, No. 2, Chin-Chung St., Taichung City (TW)

( * ) Notice: Subject to any disclaimer, the term of this patent is extended or adjusted under 35 U.S.C. 154(b) by 0 days.

(21) Appl. No.: 11/032,397

(22) Filed: Jan. 10, 2005

(30) Foreign Application Priority Data

Oct. 22, 2004 (TW) ..... 93216909 U

(51) Int. Cl.
*B63B 25/24* (2006.01)

(52) U.S. Cl. ..... 410/85; 410/77

(58) Field of Classification Search ..... 410/85, 410/77, 96, 100; 114/75; 248/499
See application file for complete search history.

(56) References Cited

U.S. PATENT DOCUMENTS 5,143,010 A * 9/1992 Behr et al. ..... 114/75
6,059,251 A * 5/2000 Gutelius et al. ..... 248/500
6,076,326 A * 6/2000 Gutelius et al. ..... 52/698
6,161,981 A * 12/2000 Dehlin ..... 403/43
6,666,633 B1 * 12/2003 Hsieh ..... 410/85
6,666,634 B1 12/2003 Hsieh
6,758,643 B1 * 7/2004 Hsieh ..... 410/85
6,908,268 B1 * 6/2005 Hsieh ..... 410/85

OTHER PUBLICATIONS

Pending U.S. Appl. No. 10/868,288.

* cited by examiner

*Primary Examiner*—H. Gutman
(74) *Attorney, Agent, or Firm*—Baker & Daniels

(57) ABSTRACT

A fastener for securing a cargo container includes a first fastener component having two rails connected and bridged by a fixed body, and a lock body mounted slidably on the two rails, the lock body having a locking hole consisting of an engaging section and a non-engaging section. A second fastener component includes a threaded stem passed threadedly through a screw hole formed in the fixed body to extend between the two rails, and a locking portion and a slide portion both slidably received in the locking hole, the slide portion being rotatable in the locking hole, the locking portion being engageable with the engaging section, and the lock body being movable from the locking portion to the slide portion and vice versa. A mechanism is provided for restraining movements of the locking portion and the slide portion relative to the lock body.

12 Claims, 7 Drawing Sheets

FASTENER FOR SECURING CARGO CONTAINERS HAVING A RESTRAINING MECHANISM

CROSS-REFERENCE TO RELATED APPLICATION

This application claims priority from Taiwanese utility model application no. 093216909 filed Oct. 22, 2004.

BACKGROUND OF THE INVENTION

1. Field of the Invention

The present invention relates to a fastener, more particularly to a fastener for securing a container on the deck of a cargo vessel or ship in which the fastening tension can be easily and simply adjusted and ineffective fastening can be avoided.

2. Description of the Related Art

Generally, when containers are being transported in a cargo vessel or ship, in order to prevent undesired movement or toppling down of the containers 11 stacked on the ship as shown in FIG. 1, lashing ropes 2 and fastening assemblies 3 are used to secure the containers 11 to deck fittings (not shown) on a deck 12 of the ship. The conventional fastening assembly 3 includes a connecting member 31 and a connecting rod 32 that are connected in threaded engagement. However, when the ship pitches and rolls in a stormy sea, the threaded connection may be loosened thus resulting in disengagement of the connecting member 31 from the connecting rod 32 and, hence, ineffective fastening.

U.S. Pat. No. 6,666,634 proposes a "Positioning Assembly for Positioning a Container on a Platform," which was intended to overcome the aforesaid drawback of the conventional fastening assembly. The positioning assembly includes a limiting seat formed with a limiting hole, and a platform-connecting rod that engages threadedly a container-connecting unit and that has an engaging stud portion for engaging the limiting hole to arrest rotation of the platform-connecting rod, thereby preventing undesired disengagement of the platform rod from the container-connecting unit. However, the limiting seat may still disengage from the platform-connecting rod due to severe rocking of the ship.

In pending U.S. patent application under Ser. No. 10/868,288 entitled, "Fastener for Securing a Container on a Vehicle," a first fastener component of a fastener assembly disclosed therein includes a lock body mounted slidably on two rails which bridge a pair of fixed bodies. A threaded stem of a second fastener component extends between the two rails as it is passed threadedly through a screw hole formed in one of the fixed bodies. In use, the stem is not rotatable when connected to a deck fitting. The first fastener component is connected to a rope and is turnable relative to the stem to tension or loosen the rope. The lock body, when engaging a locking portion on the stem, restraints relative rotation between the stem and the first fastener component so that the rope is prevented from becoming loosened undesirably.

While such fastener structure is quite satisfactory in providing reliable engagement and preventing slippage of the lock body from the stem, it is noted that upon assembly and connection of such a fastener to a deck fitting on the ship, the fastening tension can only be adjusted by first releasing the lock body from the stem, rotating the first fastener component with the lock body relative to the stem until the desired tension is obtained, and then placing the lock body back onto the stem. Such process of operation is somewhat complicated.

The present invention intends to overcome such a shortcoming while still providing a reliable engagement between the lock body and the stem of the second fastener component and preventing undesirable loosening of the rope caused by inadvertent relative rotation between the stem and the first fastener component in use.

SUMMARY OF THE INVENTION

Therefore, a main object of the present invention is to provide an improvement over a fastener of the type disclosed in the above-mentioned pending U.S. application by means of a restraining mechanism provided on the fastener so that the fastening tension can be readily and conveniently adjusted without necessitating disengagement of the lock body from the stem of the second fastener component.

According to one aspect of the present invention, a fastener for securing a cargo container, which comprises a first fastener component including a pair of rails, and a fixed body which has two ends respectively connected to the rails and a female screw hole between the two ends; a lock body mounted on the rails for sliding along the rails so as to move away or toward said fixed body, the lock body having two opposite ends abutting respectively against the rails, and a locking hole between the two ends of the lock body, the locking hole consisting of a non-engaging section and an engaging section; a second fastener component including a stem which is formed with a male thread portion for engaging the female screw hole, and a locking portion and a slide portion both slidably received in the locking hole, the slide portion being rotatable in the locking hole, and the locking portion being engageable with the engaging section so as to prevent the stem from rotation, the lock body being movable from the locking portion to the slide portion and vice versa; and a mechanism for restraining movements of the locking portion and the slide portion relative to the lock body.

In another aspect of the present invention, the second fastener component further includes a substantially U-shape connector adapted to be connected to a deck fitting and having two opposite arms each having a bore, a projection protruding outward from one of the arms, and a bolt for insertion into the bores of the arms, the bolt having a head at one end of the bolt and a button projecting from the bolt adjacent the other end of the bolt, the button abutting against the projection after the bolt is inserted into the bores with the one end and the other end of the bolt extending out of the bores.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

The construction of a preferred embodiment of the fastener according to the present invention will now be described in greater detail below.

Figure 1:
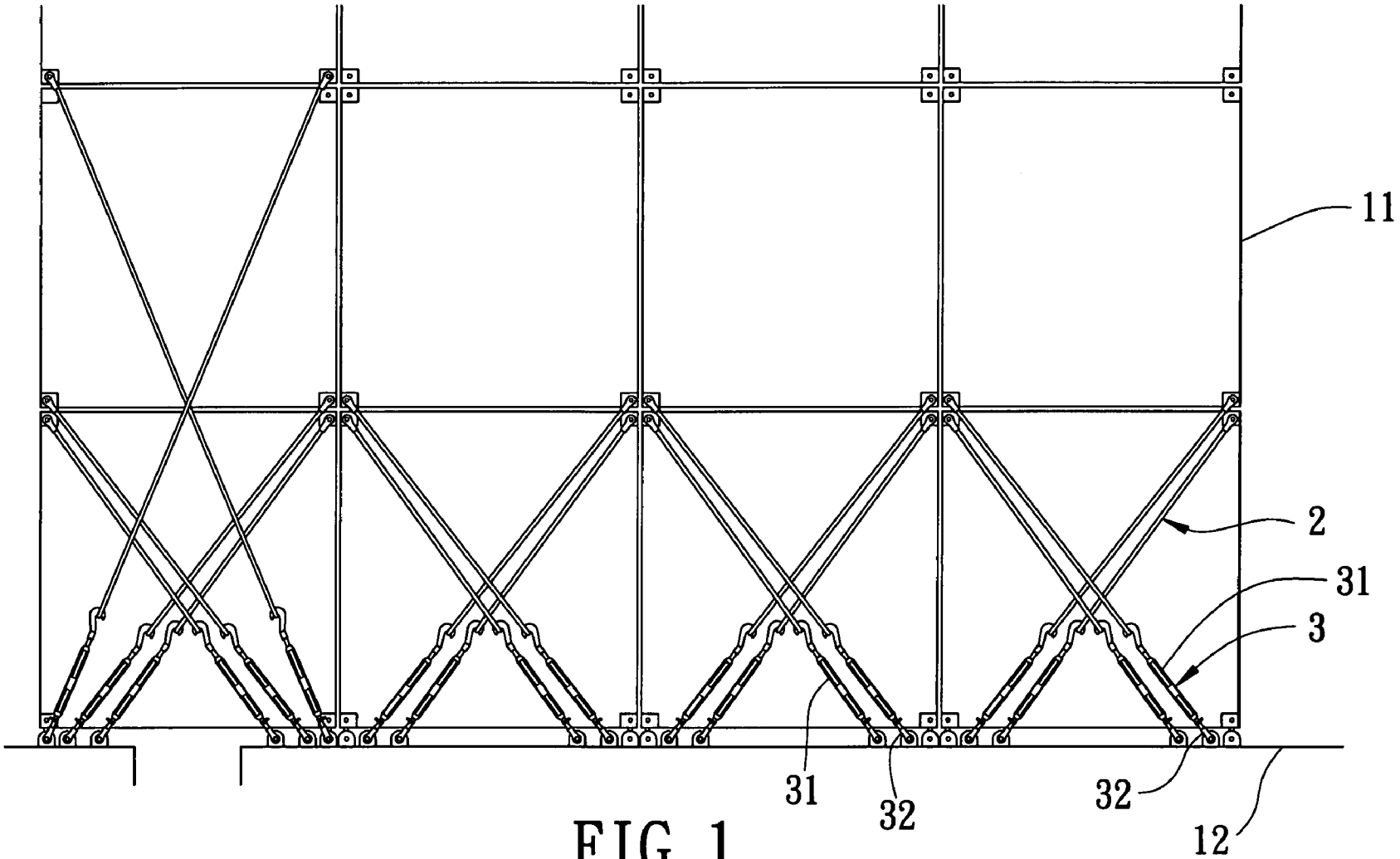
FIG. 1 PRIOR ART
FIG. 1 is a schematic view showing conventional fastener assemblies securing stacks of containers on the deck of a ship.
Figure 2:
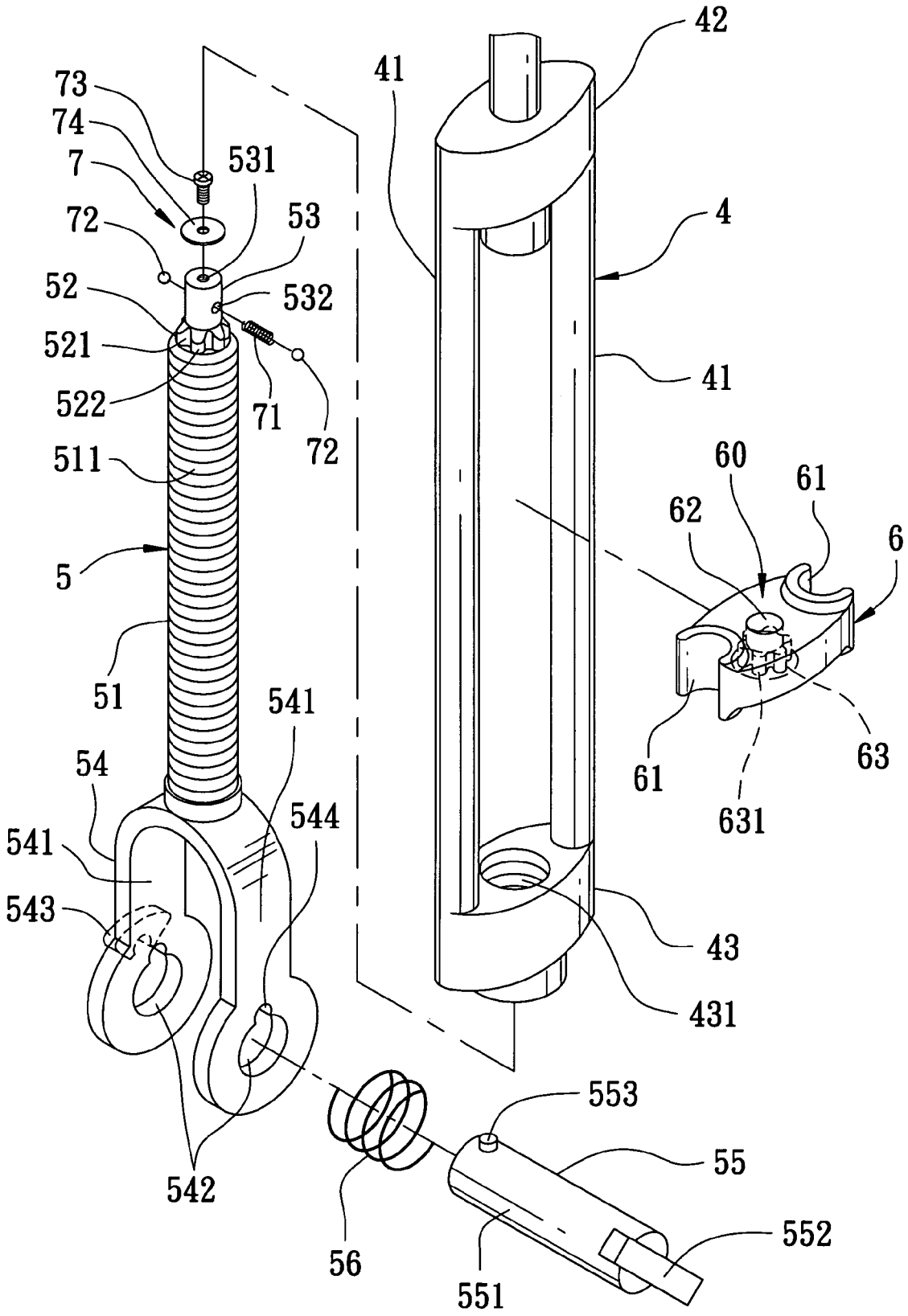
FIG. 2 is an exploded, perspective view of a preferred embodiment of the fastener according to the present invention.
Figure 3:
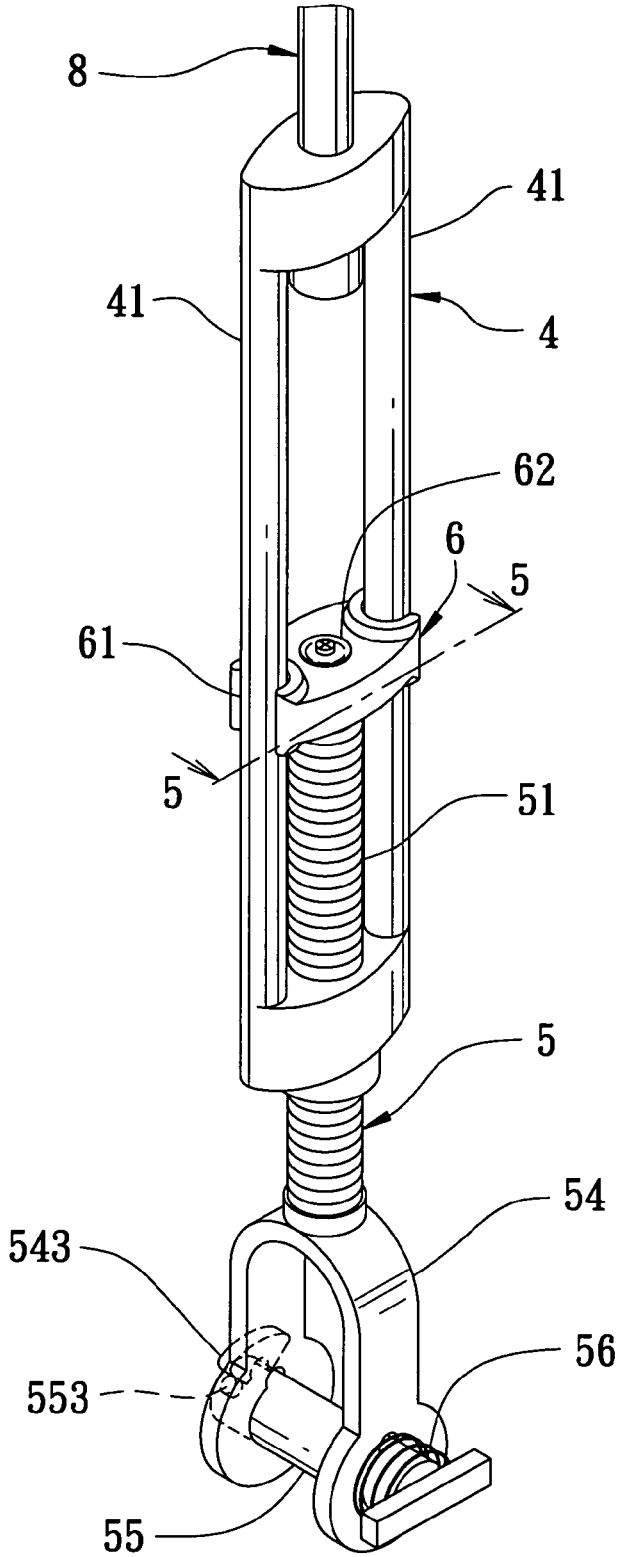
FIG. 3 is a perspective view of the preferred embodiment in the assembled state where the lock body is positioned on the slide portion such that the first fastener component with the lock body is rotatable relative to the stem.

With reference to FIGS. 2 and 3, a fastener for a cargo container according to a preferred embodiment of the present invention as shown generally comprises a first fastener component 4, a second fastener component 5, a lock body 6 and a restraining mechanism 7.

The first fastener component 4 includes a pair of rails 41 in an axially parallel arrangement and configured as rods in the present embodiment, a connecting body 42 connected to upper ends of the rails 41, and a fixed body 43 connected to lower ends of the rails 42. A female screw hole 431 is provided between the two opposing ends of the fixed body 43.

The lock body 6 is mounted on the rails 41 for sliding along the rails 41 so as to move away or toward the fixed body 43. The lock body 6 has two opposite ends 61 abutting against the rails 41, respectively, and a locking hole 60 between the opposite ends 61. The locking hole 60 consists of a non-engaging section 62 and an engaging section 63 vertically adjacent one another. The non-engaging section 62 is of a substantially circular cross section, while the engaging section 63 includes a circular hole portion having the same cross section as the non-engaging section 62 and a plurality of angularly spaced apart hole portions 631 extending from the circular hole portion.

The second fastener component 5 includes a stem 51 which is formed with a male thread portion 511, a locking portion 52 formed on one end of the stem 51, and a slide portion 53 extending from the locking portion 52. In the present embodiment, the locking portion 52 is toothed and has a plurality of radially projecting teeth 522 and a plurality of substantially V-shape recesses 521 each formed between two adjacent ones of the teeth 522. The slide portion 53 is of substantially circular cross section corresponding to the cross sectional shape of the non-engaging section 62 as well as the circular hole portion of the engaging section 63, and has a threaded blind hole 531 in the axial direction thereof and a substantially diametrical through-hole 532. The stem 51 is threadedly inserted into the female screw hole 431 and thus interposed between the rails 41 of the first fastener component 4, with the locking portion 52 and the slide portion 53 received in locking hole 60 of the lock body 6.

The restraining mechanism 7 includes at least one engaging element 72 which protrudes resiliently from the slide portion 53. In the present embodiment, two engaging elements 72 and a spring 71 biasing the engaging elements 72, all received in the through-hole 532 formed on the slide portion 53, are provided. A stop member 74 is attached to the slide portion 53 through a screw fastener 73 threadedly inserted in the blind hole 531 for preventing the lock body 6 from being released from the locking portion 52 and slide portion 53 of the stem 51, as will be described in more detail below. The engaging elements 72, in the present embodiment, are in the form of rounded beads.

Figure 4:
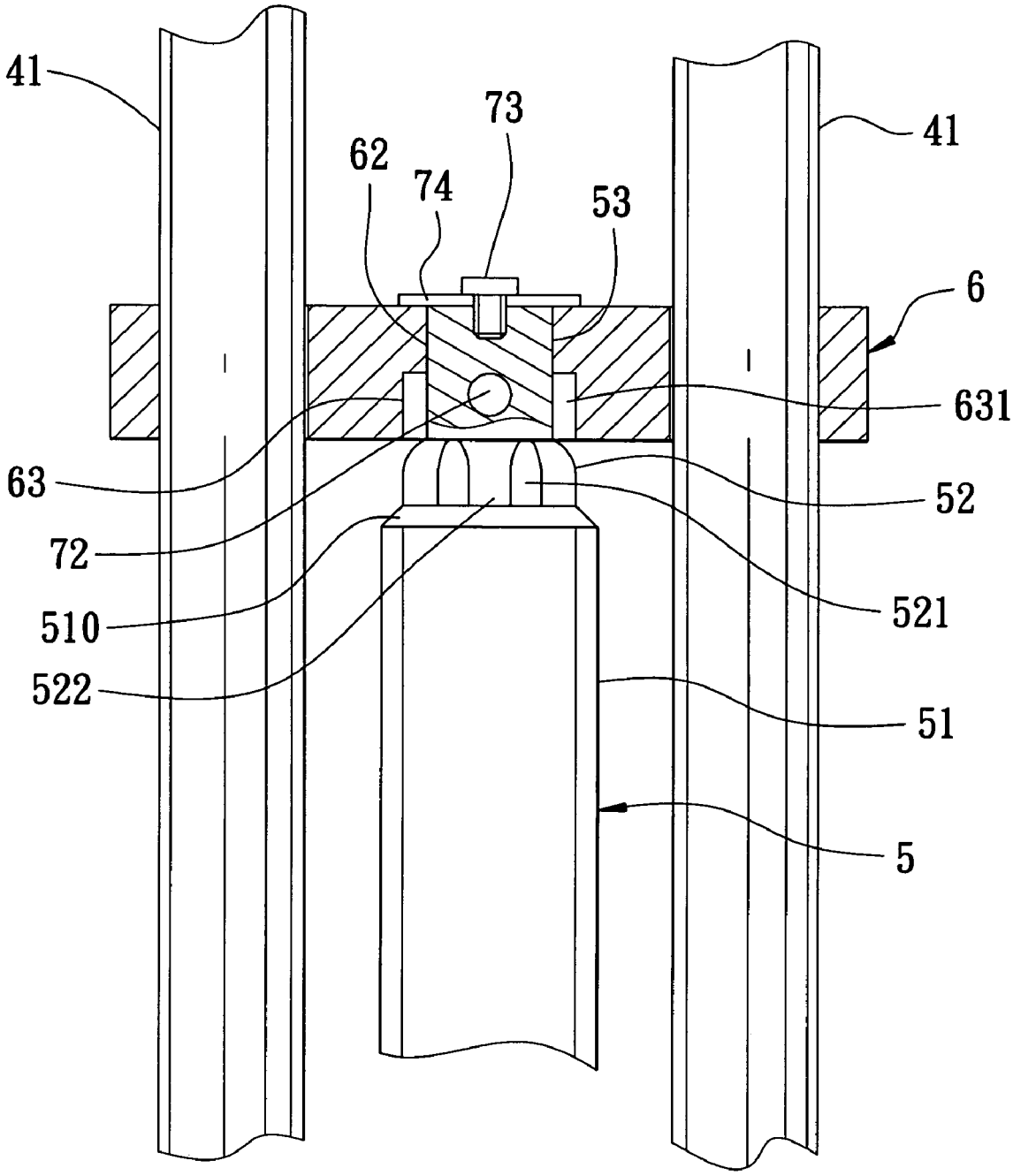
FIG. 4 is a fragmentary, sectional view showing the lock body in relation to the locking portion and slide portion of the stem.
Figure 5:
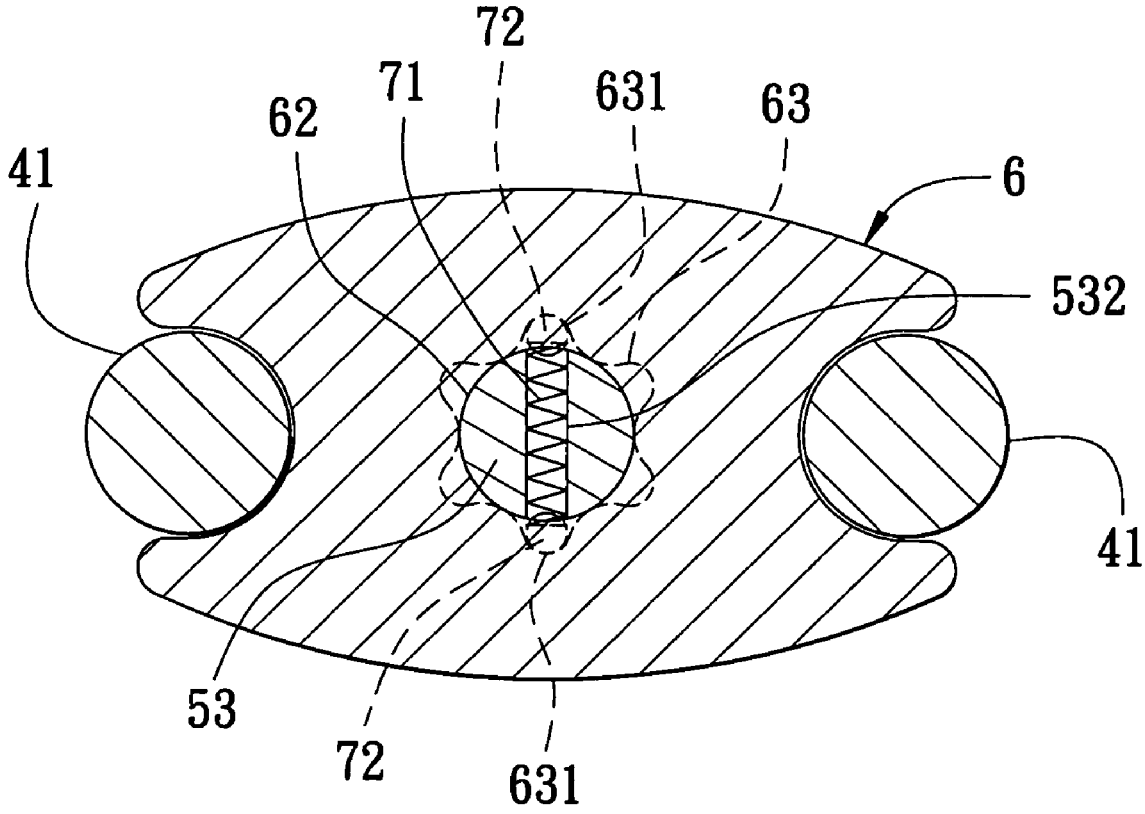
FIG. 5 is a cross sectional view taken along line 5—5 of FIG. 3 showing the engaging elements protruding into the engaging hole portions when the slide portion is within the engaging section of the locking hole.
Figure 6:
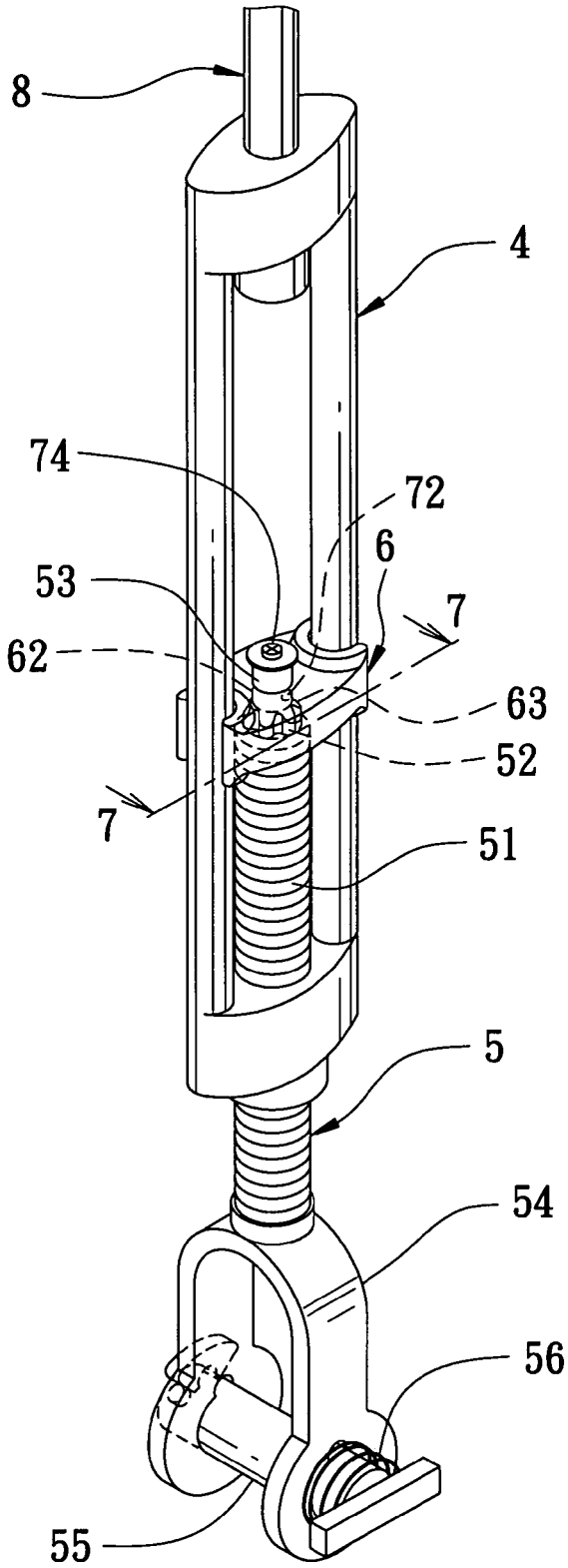
FIG. 6 is the same view as FIG. 3, but with the lock body being positioned on the locking portion.
Figure 7:
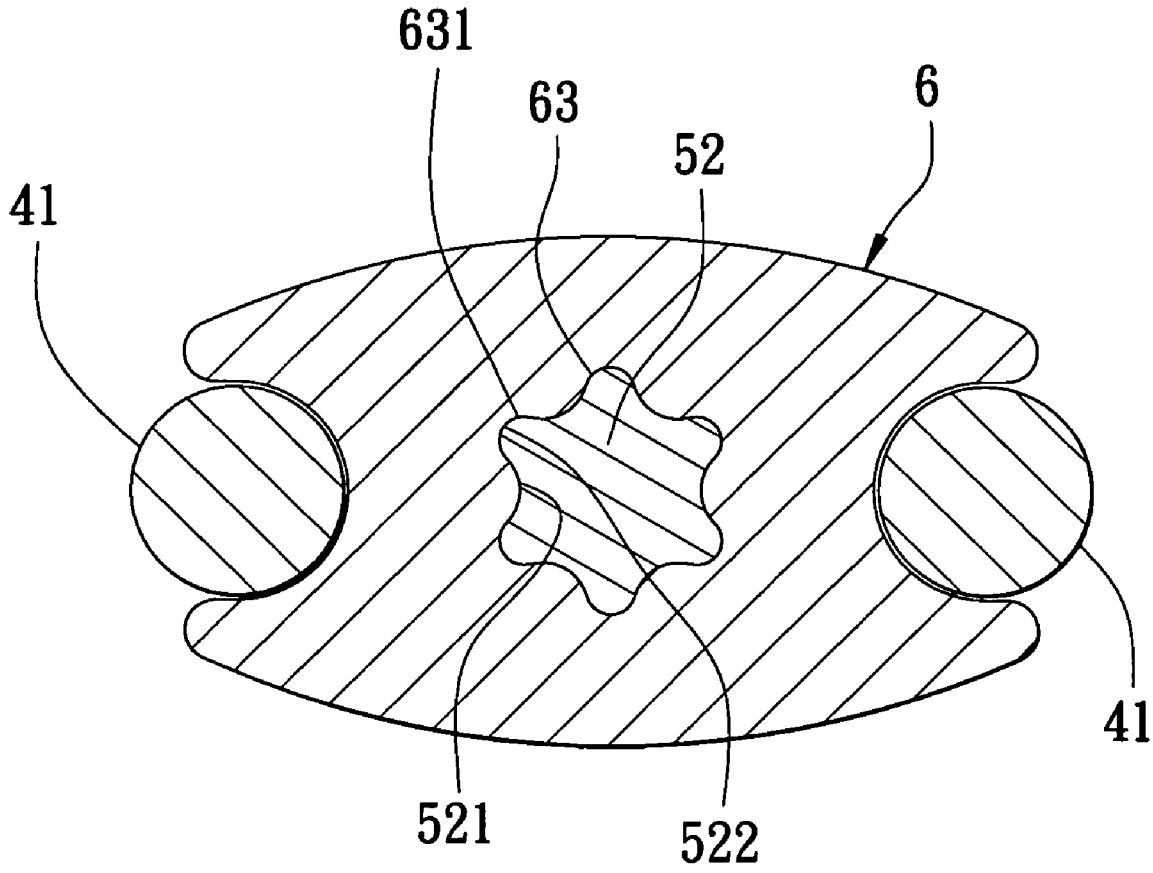
FIG. 7 is a sectional view taken along line 7—7 of FIG. 6.

The lock body 6 is movable from the locking portion 52 to the slide portion 53 where the locking portion 52 is disengaged from the engaging section 63 of the locking hole 60 of the lock body 6 such that rotation of the lock body 6 relative to the stem 51 is permitted as depicted in FIGS. 3, 4 and 5, and from the slide portion 53 back to the locking portion 52 in which the locking portion 52 is received and engaged in the engaging section 63 of the locking hole 60 thus preventing rotation of the stem 51 relative to the lock body 6, as depicted in FIGS. 6 and 7. The stop member 74 limits the vertical displacement of the lock body 6 to within the length of the locking portion 52 and slide portion 53 and prevents the lock body 6 from being released from the locking portion 52 and slide portion 53.

Referring again to FIG. 4 which more clearly depicts the rotatable position of the lock body 6, the locking portion 52 is displaced from the locking hole while the slide portion 53 is located in both the non-engaging section 62 and engaging section 63 of the locking hole. The engaging elements 72, subjected to the biasing force of the spring 71, protrude from the slide portion 53 and extend into and engage resiliently respective ones of the hole portions 631 of the engaging section 63, thereby arresting free rotation of the slide portion 53 relative to the lock body 6. Because part of the slide portion 53 is located in the non-engaging section 62 and both the slide portion 53 and non-engaging section 62 have corresponding circular cross section, the arresting effect of the engaging elements 72 will not hinder rotation of the lock body 6 relative to the stem 51 when an external force is applied to this effect. Specifically, when a force is applied to rotate the lock body 6 relative to the stem 51, the engaging elements 72 will resiliently extend and retract under the action of the external force and slide over the walls defining the engaging hole portions 631. In this rotatable position of the lock body 6, therefore, the first fastener component 4 with the lock body 6 can be rotated to adjust the threaded depth of the stem 51 in the first fastener component 4 and, hence, the fastening tension.

Accordingly, referring again to FIGS. 3 to 5, when the fastener of the present invention is used conjunction with a lashing rope 8 to secure a container (not shown) to a deck fitting (not shown), the fastening tension can be adjusted easily and simply by applying an upward force to displace the lock body 6 to the slide portion 53 from the locking portion 52, and then rotating the first fastener component 4 with the lock body 6 to adjust the threaded depth of the stem 51, and hence, the fastening tension. When the desired tension is reached, it will only be necessary to apply a downward force to move the lock body 6 downward to compress the engaging elements 72 against the spring 71, until the engaging section 63 of the lock body 6 receives the locking portion 52 (see FIGS. 6 and 7) and further downward movement of the lock body 6 is arrested by a shoulder 510 (see FIG. 4) formed between the stem 51 and the locking portion 52. In the engaged position of the lock body 6 shown in FIGS. 6 and 7, the locking portion 52 is located in the engaging section 63 and the inter-engagement between the teeth 522 of the locking portion 52 and the hole portions 631 of the engaging section 63 prevents rotation of the lock body 6 relative to the stem 51.

The fastener of the present invention not only provides reliable engagement between the lock body 6 and the stem 51 in use, but more importantly, because the sliding movement of the lock body 6 is confined within the length of the slide portion 53, the distance of travel of the lock body 6 is shortened, thereby the adjustment of fastening tension can be smoothly and easily performed. Specifically, due to the presence of the stop member 74, when the lock body 6 is lifted upward to adjust the fastening tension, the lock body 6 will not move upward uncontrollably or too much so that adjustment of the tension can be made easily within a confined short distance.

In a further aspect of the present invention, the second fastener component 5 of the embodiment shown in FIGS. 2 and 3 may further include a connector 54 formed on the other end of the stem 51 adapted to be connected to a deck fitting, and a bolt member 55 for connection to the connector 54. The connector 54 is generally "U" shaped with two opposite arms 541 each having a bore 542. An outwardly protruding projection 543 is formed on one of the arms 541. The bolt 55 includes a shank 551, a head 552 formed at one end of the shank 551, and a button 553 formed adjacent the other end of shank 551 and projecting from the shank body. A groove 544 is provided in each of the arms 541, which is connected to the respective bore 542 for passage of the button 553. To assemble the bolt 55 to the connector 54, the bolt 55 is inserted into the bores 542. The button 553 is compressible and passes through the grooves 544. The button 553 extends out of one of the bores 542 and abuts against the projection 543 as the bolt 55 is rotated to fix the bolt 55 in place, as shown in FIG. 3. The bolt 55 can be detached from the connector 54 simply by rotating the bolt 55 to release the abutting engagement between the button 553 and the projection 543, and then pulling the bolt 55 out from the bores 542. To attach the connector 54 to a deck fitting on a container ship (not shown), the bolt 55 is detached from the connector 54, then the bores 542 are aligned with the holes (not shown) on a seat (not shown) on a deck fitting (not shown), and finally the bolt 55 is inserted though the bores 542 and the holes of the seat and rotated to abut the button 553 against the projection 543.

An elastic element such as a spring 56 may be further provided around the bolt 55 between one of the arms 541 and the head 552 of the bolt 55, which imparts a resilient restoring force on the bolt member 55, so that the attachment of the connector 54 to the deck fitting is further tightened.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A fastener for securing a cargo container, comprising:

a first fastener component including a pair of rails, and a fixed body which has two ends respectively connected to said rails and a female screw hole between said two ends;

a lock body mounted on said rails for sliding along said rails so as to move away or toward said fixed body, said lock body having two opposite ends abutting respectively against said rails, and a locking hole between said ends of said lock body, said locking hole consisting of a non-engaging section and an engaging section;

a second fastener component including a stem which is formed with a male thread portion for engaging said female screw hole, and a locking portion and a slide portion both slidably received in said locking hole, said slide portion being rotatable in said locking hole, and said locking portion being engageable with said engaging section so as to prevent said stem from rotation, said lock body being movable from said locking portion to said slide portion and vice versa; and a mechanism for restraining movements of said locking portion and said slide portion relative to said lock body.

2. The fastener as claimed in claim 1, wherein said second fastener component further includes a free end extending out of said locking hole, said restraining mechanism further comprising a stop member provided on said free end for preventing said lock body from being released from said locking portion and said slide portion.

3. The fastener as claimed in claim 1, wherein said second fastener component further includes a substantially U-shape connector adapted to be connected to a deck fitting and having two opposite arms each having a bore, a projection protruding outward from one of said arms, and a bolt for insertion into said bores of said arms, said bolt having a head at one end of said bolt and a button projecting from said bolt adjacent the other end of said bolt, said button abutting against said projection after said bolt is inserted into said bores with said one end and said other end of said bolt extending out of said bores.

4. The fastener as claimed in claim 3, wherein each of said arms has a groove connected to a corresponding one of said bores for passage of said button.

5. The fastener as claimed in claim 3, wherein a spring is provided around said bolt between one of said arms and said head of said bolt.

6. The fastener as claimed in claim 1, wherein said restraining mechanism includes an engaging element which protrudes resiliently from said slide portion and engages resiliently said engaging section of said locking hole so as to limit said slide portion from rotating freely.

7. The fastener as claimed in claim 1, wherein said locking portion is a toothed portion formed on said stem, and has a plurality of teeth and recesses between said teeth.

8. The fastener as claimed in claim 7, wherein said non-engaging section is a substantially circular hole, and said engaging section includes a circular hole portion having the same cross-section as said circular hole of said non-engaging section and a plurality of angularly spaced apart engaging hole portions extending from said circular hole portion.

9. The fastener as claimed in claim 8, wherein said slide portion is movable between said engaging section and said non-engaging section of said locking hole and includes a substantially diametrical through hole, said restraining mechanism including at least one engaging element and a spring both of which are received in said through hole, said engaging element being biased by said spring to protrude outward from said slide portion so as to engage one of said engaging hole portions of said engaging section when said slide portion is within said engaging section.

10. A fastener for securing a cargo container, comprising:

a first fastener component including a pair of rails, and a fixed body which has two ends respectively connected to said rails and a female screw hole between said two ends;

a lock body mounted on said rails for sliding along said rails so as to move away or toward said fixed body, said lock body having two opposite ends abutting respectively against said rails, and a locking hole between said ends of said lock body, said locking hole consisting of a non-engaging section and an engaging section; and a second fastener component including a stem which is formed with a male thread portion for engaging said female screw hole, and a substantially U-shape connector adapted to be connected to a deck fitting and having two opposite arms each having a bore, a projection protruding outward from one of said arms, and a bolt for insertion into said bores of said arms, said bolt having a head at one end of said bolt and a button projecting from said bolt adjacent the other end of said bolt, said button abutting against said projection after said bolt is inserted into said bores with said one end and said other end of said bolt extending out of said bores.

11. The fastener as claimed in claim 10, wherein each of said arms has a groove connected to a corresponding one of said bores for passage of said button.

12. The fastener as claimed in claim 10, wherein a spring is provided around said bolt between one of said arms and said head of said bolt.

* * * * *